US006949013B1

(12) United States Patent
Suzuki

(10) Patent No.: US 6,949,013 B1
(45) Date of Patent: Sep. 27, 2005

(54) PERIPHERAL LENGTH CORRECTION DEVICE OF METAL RINGS

(75) Inventor: Takefumi Suzuki, Shizuoka (JP)

(73) Assignee: JATCO Ltd, (JP)

( * ) Notice: Subject to any disclaimer, the term of this patent is extended or adjusted under 35 U.S.C. 154(b) by 0 days.

(21) Appl. No.: 10/644,729

(22) Filed: Aug. 21, 2003

(30) Foreign Application Priority Data

Aug. 30, 2002 (JP) ..... 2002-256116

(51) Int. Cl.[7] ..... B24B 7/00; A47L 5/38
(52) U.S. Cl. ..... 451/66; 451/109; 15/308
(58) Field of Search ..... 451/103, 109, 451/110–112, 66–68; 15/99, 100, 22.3, 32, 15/34, 250.22, 250.29, 421, 233, 256.5, 308, 15/306

(56) References Cited

U.S. PATENT DOCUMENTS

| | | | | |
|---|---|---|---|---|
| 2,920,987 | A * | 1/1960 | Lionel et al. | 15/77 |
| 3,237,230 | A * | 3/1966 | Forrest | 15/100 |
| 3,984,241 | A * | 10/1976 | Schrempp et al. | 430/127 |
| 4,116,762 | A * | 9/1978 | Gardiner | 15/302 |
| 4,704,963 | A * | 11/1987 | Nishimura et al. | 15/256.5 |
| 5,738,571 | A * | 4/1998 | Kitahama et al. | 451/188 |
| 5,991,954 | A * | 11/1999 | Kubota et al. | 15/100 |
| 6,318,140 | B1 * | 11/2001 | Yamagishi et al. | 72/110 |

FOREIGN PATENT DOCUMENTS

| | | |
|---|---|---|
| EP | 1 092 488 | 4/2001 |
| JP | 61 082910 | 4/1986 |
| JP | 11-290971 | 10/1999 |
| JP | 2001-105050 | 4/2001 |
| JP | 2001 105050 | 4/2001 |
| JP | 2002-178008 | 6/2002 |

* cited by examiner

*Primary Examiner*—Hadi Sahkeri
(74) *Attorney, Agent, or Firm*—Blank Rome LLP

(57) ABSTRACT

In the peripheral length correction device of metal rings, a metal ring is laid on a driving roller and a driven roller which are displaceable in mutually separating directions. One or both of the rollers are displaced while rotating the rollers, thereby applying tensile stress to the metal ring to correct the peripheral length thereof. The peripheral length correction device of metal rings further comprises a foreign substance removal head, which functions as the removal means for removing foreign substances adhered to the inner peripheral surface of the metal ring, and as the re-adhesion prevention means for preventing re-adhesion of the foreign substances removed by the removal means from the metal ring. There is provided a peripheral length correction device of metal rings which can prevent the reduction in production yield without damaging the rollers even if foreign substances (residual pieces of cutting metal or the like) adhere to the surface of the metal ring in a preceding process (solution treatment or the like) prior to the correction process.

2 Claims, 4 Drawing Sheets

PERIPHERAL LENGTH CORRECTION DEVICE OF METAL RINGS

BACKGROUND OF THE INVENTION

The present invention relates to a peripheral length correction device of metal rings, and more particularly to a peripheral length correction device used to correct the peripheral length of metal rings which constitute a V-belt type continuously variable transmission belt (hereinafter referred to as "CVT belt").

Conventionally, there is a known CVT belt which is structured by layering about ten thin metal rings of 0.2 mm thickness in succession with steel metal elements inserted therein. For example, as disclosed in "REALIZATION OF THE IDEAL MAXIMUM PERFORMANCE OF A CVT TRANSMISSION" by Tomomi Miyaji, [on line], [searched on Aug. 25, 2002], Internet <URL: http://www.idemitsu-.co.jp/lube/cvtbody 2.html> and illustrated in FIG. 4 of this homepage.

The CVT belt of such a structure is manufactured as follows. First, the ends of the thin sheet metal, which are made of super strong steel such as maraging steel, are welded together to form a ring-shaped drum. The drum is then cut into the predetermined width and rolled out to constitute metal rings of a predetermined peripheral length. The metal rings are then subjected to a solution treatment or the like. This is followed by a peripheral length correction process, which is carried out by a "peripheral length correction device" to correct the metal rings to an accurate peripheral length. The metal rings are further subjected to an aging treatment, nitriding and the like to enhance their hardness. A plurality of such metal rings (about ten mentioned above) which vary slightly in peripheral length from one to the other are mutually layered to form a CVT belt. Thus, the peripheral length correction device is an important and indispensable device to carry out the lamination of multiple thin metal rings to form one CVT belt.

As a conventional peripheral length correction device, there is known device which carries a solution treated and the like metal rings (hereinafter referred to as "receiving correction rings") laid on two rollers (driving roller and driven roller) of which either or both are displaceable in mutually separating directions while rotating the rollers, and thereby applying tensile stress to the receiving correction rings to correct their peripheral length. This device is described in Japanese Laid-Open (Kokai) Patent Application (A) numbered 2001-105050 titled "METHOD FOR PERIPHERAL LENGTH CORRECTION OF METAL RINGS."

The conventional peripheral length correction device is useful in that each of the number of metal rings constituting a CVT belt is corrected to a shorter peripheral length for the inner side of the metal ring and a longer peripheral length for the outer side of the metal ring. Therefore, the necessary peripheral length difference for layering the metal rings can be accordingly provided.

However, for example when foreign substances (residual pieces of cutting metal or the like) adhere to the surface of a metal ring in a preceding process (solution treatment or the like) prior to the correction process, the foreign substances cut into the roller surface of the peripheral length correction device, consequently creating a problem by causing damage to the rollers of the peripheral length correction device. Additionally, if the impaired roller is used as is a number of defective metal rings with damaged surfaces will be produced. Consequently, this creates a problem of reduced production yield.

SUMMARY OF THE INVENTION

The present invention has been made for the purpose of solving the circumstances mentioned above. Accordingly, the object of the present invention is to provide a peripheral length correction device which does not damage the rollers even if foreign substances (residual pieces of cutting metal or the like) have adhered to the surface of a metal ring in a preceding process (solution treatment or the like) prior to the correction process, and prevent diminished production yield.

The present invention pertains to a peripheral length correction device of metal rings, wherein a metal ring is laid on at least two rollers which are displaceable in mutually separating directions. One or both of the rollers are displaced while rotating the rollers, thereby applying tensile stress to the metal ring to correct the peripheral length thereof and is characterized in comprising: a removal means for removing foreign substances adhered to the inner peripheral surface of the metal ring; and a re-adhesion prevention means for preventing re-adhesion of the foreign substances removed by the removal means to the metal ring.

According to the invention, when foreign substances (residual pieces of cutting metal or the like) are adhered to the surface of a metal ring in a preceding process (solution treatment or the like) prior to the correction process, the foreign substances are removed by the removal means, and re-adhesion of the removed foreign substances to the metal ring is prevented by the re-adhesion prevention means. Therefore, even if foreign substances are adhered to the surface of a metal ring, it is possible to prevent a reduction in yield by maintaining the quality of the metal rings without damaging the driving roller or the driven roller.

A preferred mode of the invention is that the removal means has an abutting body abutted on the inner peripheral surface of the metal ring with a predetermined pressing force.

According to this mode, by adjusting the pressing force applied to the abutting body to make it optimal, it is possible to effectively remove foreign substances; from a substance loosely adhered to the inner peripheral surface of the metal ring to a substance firmly adhered thereto.

The abutting body is a rotary brush made of a static free material.

According to this mode, costs can be reduced by simplifying the structure of the abutting body, and generation of static electricity can be prevented during removal of the foreign substances, whereby re-adhesion of the foreign substances can be prevented.

Alternatively, the re-adhesion prevention means suctions away the foreign substances removed by the removal means to prevent the re-adhesion thereof to the metal rings.

Corresponding to this mode, as the removed foreign substances are suctioned away by negative pressure or the like, it is possible to prevent the re-adhesion of the foreign substances as a result of its simple configuration.

Furthermore, the abutting body is driven by a predetermined driving mechanism. The driving mechanism can move the abutting body in the short direction of the inner peripheral surface of the metal ring laid on the rollers. The abutting body is moved so that the separating distance in the direction vertical to the inner peripheral surface of the metal ring can be increased as the moving distance in the short direction becomes larger.

In this modes the pressing force of the abutting body can be adjusted by controlling the moving amount of the abutting body. Moreover, since the moving direction is set in the short direction of the inner peripheral surface of the metal ring laid on the rollers, it is possible to prevent interference between the metal ring and the abutting body by increasing the moving amount of the abutting body in the short direction when the metal ring is handled to lay on the rollers.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 4 is a state diagram of the foreign substance removal position, the standby position, and the foreign substance removal head 5 in an optional position there between.

DETAILED DESCRIPTION OF THE PREFERRED EMBODIMENT

Figure 1A:
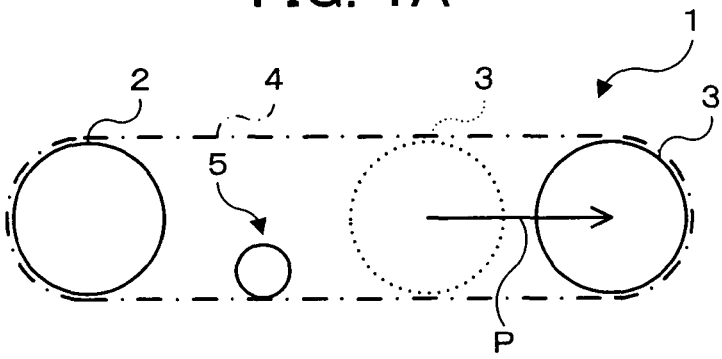
FIGS. 1A to 1D are respectively a top view, a side elevation view, a main section enlarged view, and a main section perspective view of a peripheral length correction device of an embodiment.
Figure 1B:
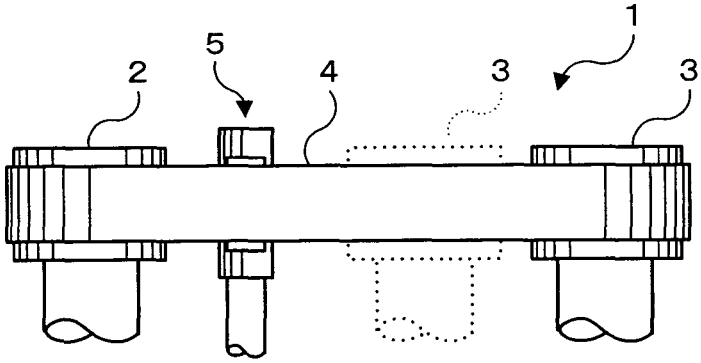
Figure 1C:
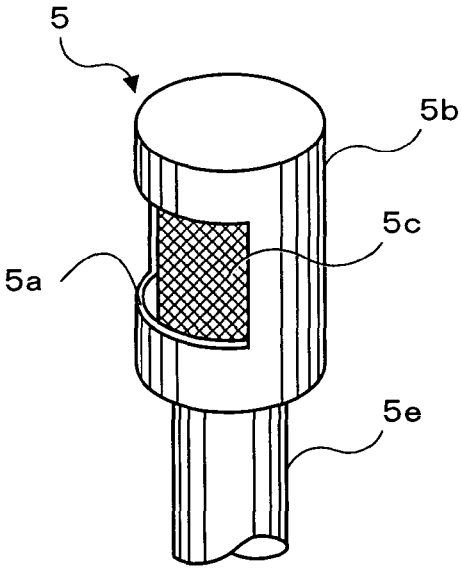
Figure 1D:
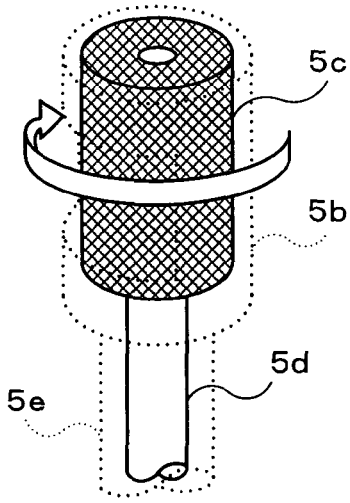

The present invention will hereinafter be described in detail with reference to the preferred embodiments shown in the accompanying drawings.

FIGS. 1A to 1D are respectively a top view, a side view, a main section enlarged view and a main section perspective view.

In the drawings, the peripheral length correction device of metal rings 1 has a driving roller 2 and a rotation-free driven roller 3 which are rotary-driven by a drive means (not shown). The two rollers (driving roller 2 and driven roller 3) are displaceable in mutually separating directions. For example, a rotation axis position of one roller (hereinafter referred to as "driving roller 2") is fixed, and a rotation axis position of the other roller (hereinafter referred to as "driven roller 3") can be moved closer to or farther apart from the driving roller 2 within a predetermined range in a direction to the rotation axis of the driving roller 2. The driven roller 3 indicated by dotted figure lines in the drawing represents a position when it is moved closest to the driving roller 2 (hereinafter referred to as "closest position"). The driven roller 3 indicated by a solid line in the drawing represents a position when it is moved outermost from the driving roller 2 (hereinafter referred to as "outermost position").

Initially when a peripheral length correction process is carried out, the driven roller 3 is moved to the closest position to lay the metal ring 4 on the driving roller 2 and the driven roller 3. Then, after the driven roller 3 is moved toward the outermost position by a proper amount to take up the slack of the metal ring 4, the driven roller 3 is moved to the outermost position while the driving roller 2 is rotary-driven. In this movement, applying pressure P on the driving roller 2 generates tensile stress on the metal ring in a peripheral direction, thus a peripheral length of the metal ring 4 can be extended (corrected) to a desired length through adjusting the amount of the pressure P and the applying duration thereof.

In the shown peripheral length correction device of metal rings 1, the two rollers (driving roller 2 and driven roller 3) are displaceable in the mutually separating positions and are displaced to apply the tensile stress to the metal ring 4. However, the device is not limited to this configuration. For example, a third roller (correction roller) may be added. This correction roller may be displaced to apply tensile stress to the metal ring 4 as shown in Japanese patent application number 2001-105050 described above.

The peripheral length correction device of metal rings 1 of this embodiment is provided with the aforementioned components necessary for the peripheral length correction process, and moreover comprises the following characteristic components comprising the foreign substance removal head 5 and its accessory components. That is, the foreign substance removal head 5 is constituted by mounting a rotary brush 5*c* inside a cylindrical head cover 5*b* which has an opening 5*a* formed on part of the side face, and inserting a rotary shaft 5*d* of the rotary brush 5*c* through the head support pipe 5*e*.

The head support pipe 5*e* has such a constitution as negative pressure is applied from a later described pneumatic pump. This negative pressure is applied through the head support pipe 5*e* to the opening 5*a* of the head cover 5*b* to make it function as a suction port. The rotary brush 5*c* is rotary-driven in a predetermined direction by a later described rotary-driven section. The foreign substance removal head 5 can be freely moved between a shown position (hereinafter referred to as "foreign substance removal position") and a "standby position" (standby position when the metal ring 4 is installed) in a described below moving mechanism.

Figure 2:
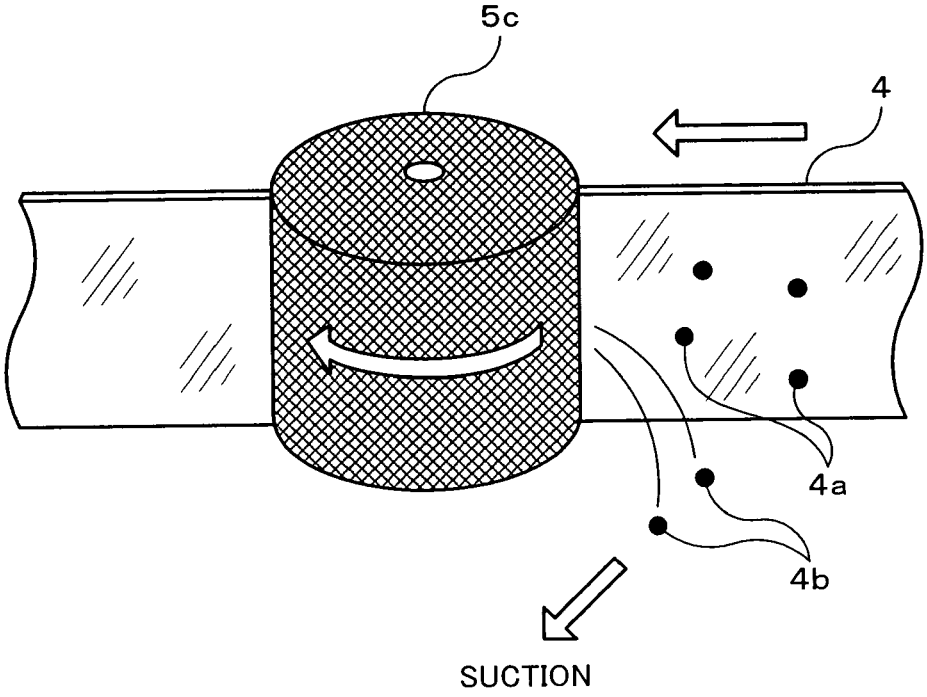
FIG. 2 is a view of the positional relation between the rotary brush 5*c* and the metal belt 4 in the foreign substance removal position.

FIG. 2 is a view of a positional relation between the rotary brush 5*c* and the metal ring 4 in the foreign substance removal position. Now, assuming that foreign substances 4*a* (residual pieces of cutting metal or the like) are adhered to the inner peripheral surface of the metal ring 4 in a preceding process (solution treatment or the like) and the foreign substances 4*a* are left remaining in place, they will cut into the surface of the driving roller 2 or the driven roller 3 and damage the rollers. If the damaged roller(s) continues to be used, the metal ring 4 thereafter will be damaged when the peripheral length correction process is performed. These defective products are then rejected and directly cause a reduction in production yield.

According to the embodiment, the rotary brush 5*c* is rotated and abutted on the inner peripheral surface of the metal ring 4 by a proper pressing force making it possible to remove the foreign substances 4*a* adhered to the inner peripheral surface of the metal ring 4. Moreover, since the removed foreign substances 4*b* are suctioned away by the negative pressure, it is also possible to prevent re-adhesion to the metal ring 4. Here, the material of the rotary brush 5*c*, a static free material such as horse hair or wool is preferably used. This material has the precise degree of toughness needed to remove the foreign substances 4*a* firmly adhered to the inner peripheral surface of the metal ring 4, is highly wear resistant, and no static electricity is induced by contact with the metal ring 4. Nylon or felt buff can also be used by being subjected to an antistatic treatment.

Figure 3:
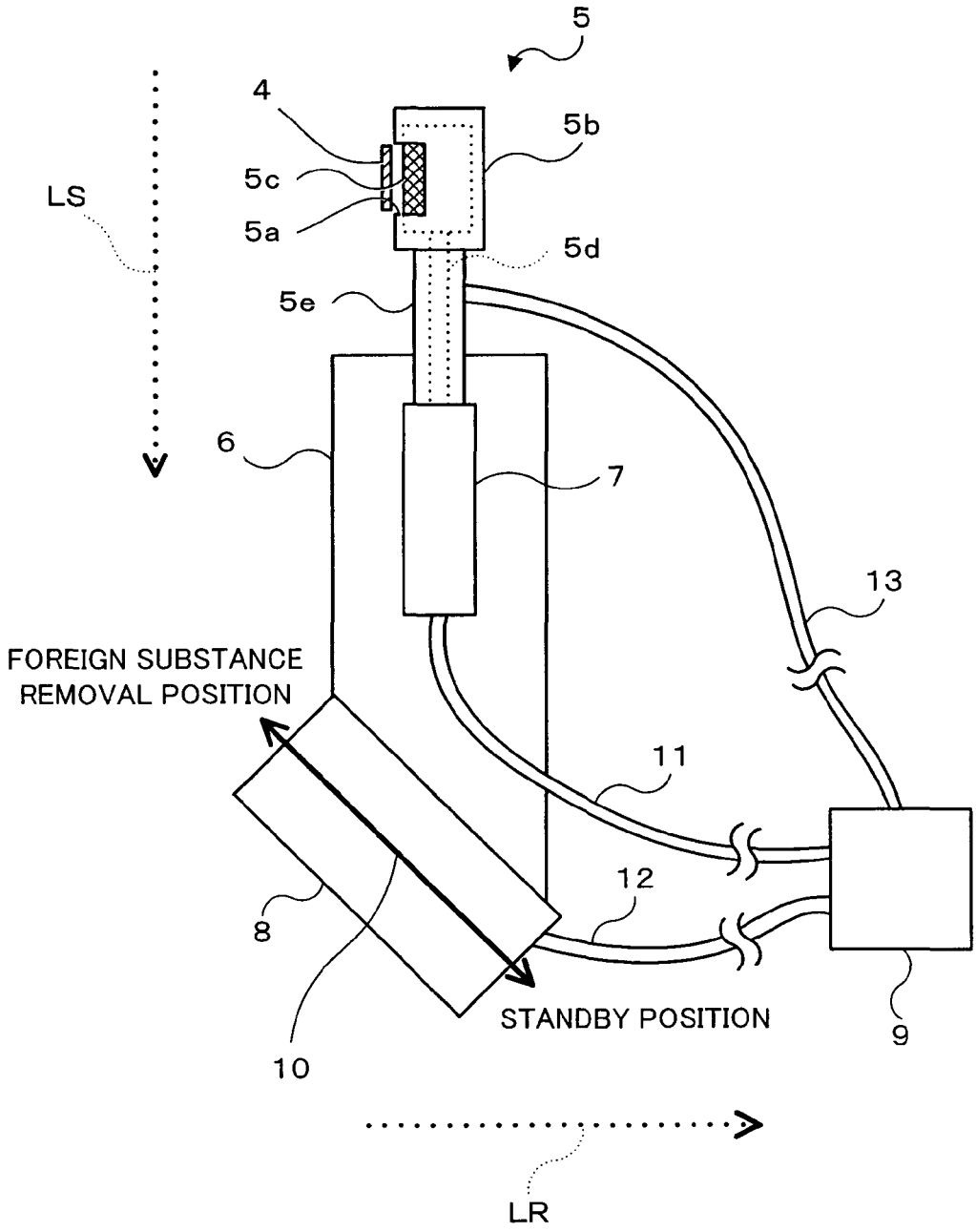
FIG. 3 is a constitutional view of the foreign substance removal head 5 and its related components.

FIG. 3 is a block diagram of the foreign substance removal head 5 and its related components. In the drawing, the head support pipe 5*e* of the foreign substance removal head 5 is attached to a substrate 6. The rotary-driven section 7 of the rotary brush 5*c* and a moving mechanism section 8 of the foreign substance removal head 5 are disposed on the substrate 6. Both the rotary-driven section 7 and the moving mechanism section 8 use air pressure generated by a pneumatic pump 9 as a power source. That is, the rotary-driven section 7 provides the rotary-drive for the rotary shaft 5*d* of the rotary brush 5*c* by means of receiving the air pressure from pneumatic pump 9 (e.g., an air motor). The moving mechanism section 8 also receives air pressure to move the substrate 6 in both directions along a shown arrow 10, and can move the foreign substance removal head 5 integrated with the substrate 6 between a "foreign substance removal position" and a "standby position" or to an optional position there between (e.g., an air cylinder).

The shown arrow 10 indicates a right downward oblique traveling direction on a drawing surface, which means the following. Namely, if the short direction of the inner peripheral surface of the metal ring 4 laid on the driving roller 2 and the driven roller 3 is LS, the foreign substance removal head can be moved along this direction LS. As the moving distance in the short direction LS is larger (downward movement on the drawing surface is larger), a separating direction (distance in a right direction LR on the drawing surface) in the vertical direction of the inner peripheral surface of the metal ring 4 can be increased. That is, the shown arrow 10 means the combined direction of LS and LR (a vector direction).

The pneumatic pump 9 is designed to generate air pressure necessary for the power source of the rotary-driven section 7 and the moving mechanism section 8, and negative pressure is applied to the opening 5*a* of the foreign substance removal head 5. The air pressure generated at the pneumatic pump 9 is supplied through flexible pipes 11 and 12 to each of the respective rotary-driven section 7 and the moving mechanism section 8 when necessary. Specifically, when the rotary brush 5*c* is rotated and when the substrate 6 is moved to the foreign substance removal position, the standby position or the optional position there between. The negative pressure generated at the pneumatic pump 9 is supplied through a flexible pipe 13 to the head support pipe 5*e* when removing the foreign substances that are suctioned away.

Figure 4:
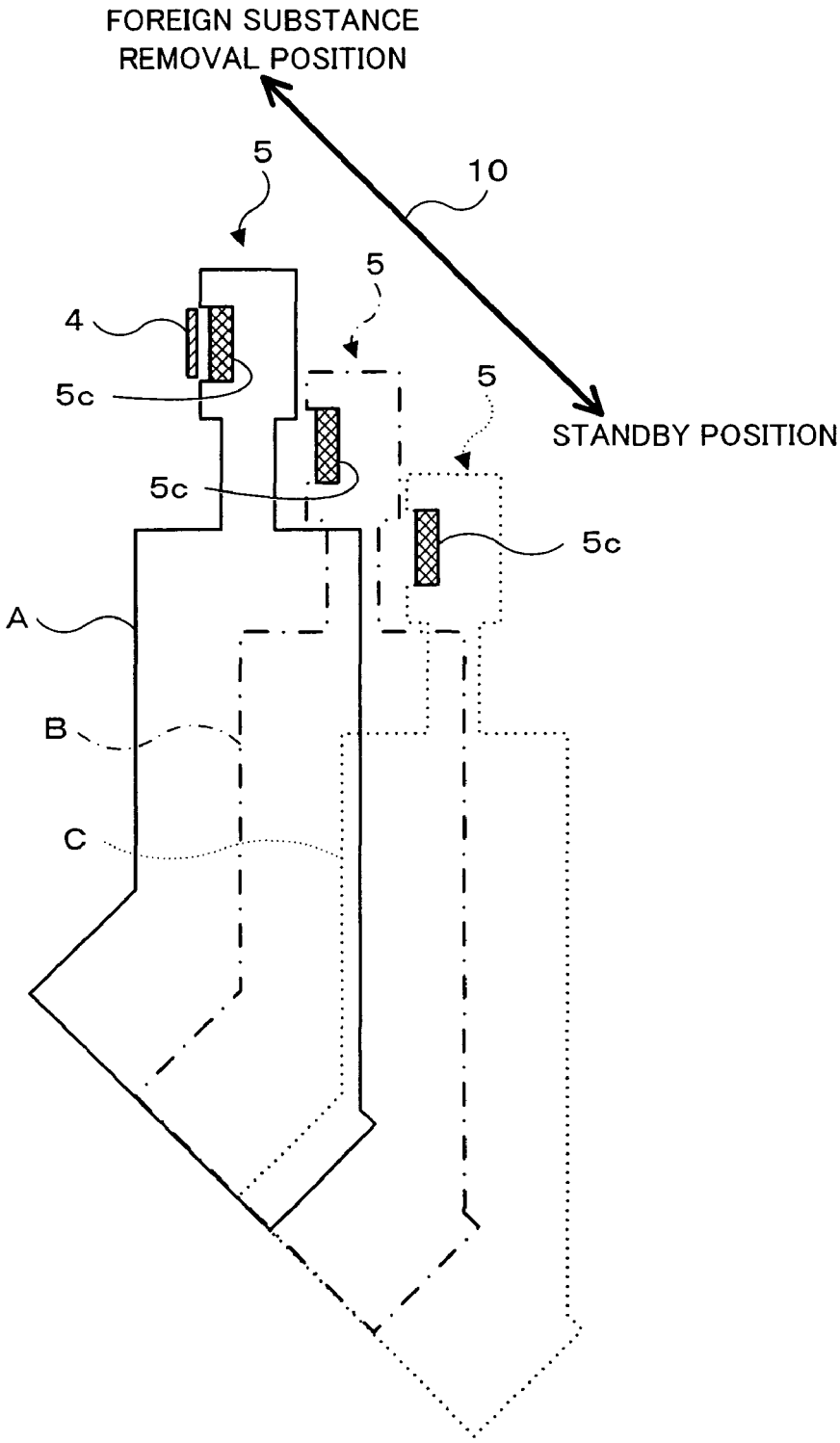

FIG. 4 is a state diagram of the foreign substance removal head 5 in the foreign substance removal position, the standby position and the optional position therebetween. In the drawing, A indicates the foreign substance removal position, C the standby position, and B the optional position there between. When the foreign substance removal head 5 is in the foreign substance removing position (A), the rotary brush 5*c* is abutted on the inner peripheral surface of the metal ring 4 by a predetermined pressing force. The pressing force reaches maximum when the position (position along the direction of the arrow 10) of the foreign substance removal head 5 coincides with the foreign substance removal position (A). When slightly separated, the pressing force is reduced corresponding to the separating direction. Thus, simply by adjusting the moving amount of the substrate 6 by the moving mechanism section 8, it is possible to adjust the pressing force between the rotary brush 5*c* and the inner peripheral surface of the metal ring 4.

Additionally, when the foreign substance removal head 5 is in the standby position (C) or a position near the standby position (C), the foreign substance removal head 5 is positioned lower than the setting position of the metal ring 4 (position when it is laid on the driving roller 2 and the driven roller 3) in the drawing. Thus, as the foreign substance removal head 5 in the standby position does not interfere with the metal ring 4, it never stands in the way when the metal ring 4 is laid on the driving roller 2 and the driven roller 3.

As apparent from the foregoing, the peripheral length correction device of metal rings 1 of the embodiment can provide the following advantages.

(1) First, the driven roller 3 is moved to the closest position when the metal ring 4 is laid on the driving roller 2 and the driven roller 3. Then the driven roller 3 is moved toward the outermost position by a proper amount to take up the slack of the metal ring 4. Subsequently, when the driving roller 2 is rotary-driven and the driven roller 3 is moved toward the outermost position, pressure P is applied to the driving roller 2 while moving, whereby tensile stress can be applied in the peripheral direction of the metal ring 4. As in the case of the conventional technology, by adjusting the amount of pressure P and the duration of application thereof, the peripheral length of the metal ring 4 can be extended (corrected).

(2) The rotary brush 5*c* is rotated and abutted on the inner peripheral surface of the metal ring 4 by a proper pressing force, whereby the foreign substances 4*a* adhered to the inner peripheral surface of the metal ring 4 can be removed. Moreover, since the removed foreign substances 4*b* are suctioned away by the negative pressure, re-adhesion thereof to the metal ring 4 can also be prevented.

(3) The rotary brush 5*c* is abutted on the inner peripheral surface of the metal ring 4 by the predetermined pressing force. Although the pressing force reaches its maximum when the position of the foreign substance removal head 5 (position along the direction of the arrow 10) coincides with the foreign substance removal position (A), when slightly separated, the pressing force is reduced corresponding to the separating distance. Thus, simply by adjusting the moving amount of the substrate 6 by the moving mechanism section 8, it is possible to adjust the pressing force between the rotary brush 5*c* and the inner peripheral surface of the metal belt 4.

(4) When the foreign substance removal head 5 is in the standby position (C) or in a position near the standby position (C), the foreign substance removal head 5 is positioned lower than the setting position of the metal ring 4 (position when it is laid on the driving roller 2 and the driven roller 3). Thus, since the foreign substance removal head 5 in the standby position does not interfere with the metal ring 4, it never stands in the way when the metal ring 4 is laid on the driving roller 2 and the driven roller 3.

According to the embodiment, the foreign substances are removed by using the rotary brush 5*c*. However, the invention is not limited to this as an abutting body other than the brush may be used. However, generally in the metal rings of a CVT belt, curves (also referred to as "crowning") are frequently formed in its sectional direction as contrivance of alignment during layering. Therefore, a preferable component such as a brush where the abutting portion is freely deformed is used from the standpoint of "fittability" to the curved surface.

Furthermore, according to the embodiment, the rotary-driven section 7 is fixed to the substrate 6. However, in the form of the above operation if the rotary-driven structure is attached to the substrate 6 through an elastic body, such as a coil spring to enable setting adjustment of the elastic body, the pressing force of the rotary brush 5*c* to the metal ring 4 can be varied. By such a structure, foreign substance removal effect may be adjusted when necessary.

According to the present invention, if foreign substances (residual pieces of cutting metal or the like) are adhered to the surface of a metal ring in the preceding process (solution treatment or the like) prior to the correction process, the foreign substances are removed by the removal means, and re-adhesion of the removed foreign substances to the metal ring is prevented by the re-adhesion prevention means. Therefore, even if foreign substances are adhered to the surface of a metal ring, it is possible to prevent a reduction in production yield by maintaining the quality of the metal rings without damaging the driving roller or the driven roller.

According to the preferred mode of the present invention, by adjusting the pressing force applied to the abutting body to make it optimal, it is possible to effectively remove foreign substances ranging from substances loosely adhered to the inner peripheral surface of the metal rings to substances firmly adhered thereto.

Costs can be reduced by simplifying the structure of the

What is claimed is:

1. A peripheral length correction device of metal rings with at least two rollers upon which a metal ring is laid, which are displaceable in mutually separating directions, whereby tensile stress can be applied to said metal ring by displacing one or both of said rollers while rotating said rollers to correct a peripheral length thereof, said device is characterized by comprising:

a removal means for removing foreign substances adhered to an inner peripheral surface of said metal ring; and a re-adhesion prevention means for preventing re-adhesion of said foreign substances removed by said removal means to said metal ring;

said removal means has an abutting body which is abutted on the inner peripheral surface of said metal ring by a predetermined pressing force;

said abutting body is driven by a predetermined driving mechanism;

said driving mechanism can move said abutting body in a short direction of the inner peripheral surface of said metal ring laid upon said rollers; and said abutting body when said metal ring is set to said rollers after being placed in a standby position separated from within said metal ring is moved to within said metal ring and said abutting body is made to contact said metal ring inner peripheral surface by said driving mechanism.

2. The peripheral length correction device of metal rings as set forth in claim 1, wherein said abutting body is moved in such a way that a separating distance in the direction vertical to the inner peripheral surface of said metal ring is increased as the moving distance in the short direction becomes larger.

* * * * *